US007526936B2

(12) United States Patent
Niskanen et al.

(10) Patent No.: US 7,526,936 B2
(45) Date of Patent: May 5, 2009

(54) HIDDEN KEY CYLINDER

(75) Inventors: Jason David Niskanen, Keswick (CA); Krzysztof Groszkowski, Newmarket (CA); Andrew R. Daniels, Sharon (CA); Dragan Mrkovic, Newmarket (CA)

(73) Assignee: Magna Closures Inc., Newmarket, Ontario (CA)

( * ) Notice: Subject to any disclaimer, the term of this patent is extended or adjusted under 35 U.S.C. 154(b) by 26 days.

(21) Appl. No.: 11/675,103

(22) Filed: Feb. 15, 2007

(65) Prior Publication Data

US 2007/0193320 A1 Aug. 23, 2007

Related U.S. Application Data

(60) Provisional application No. 60/775,085, filed on Feb. 21, 2006.

(51) Int. Cl.
*E05B 13/02* (2006.01)

(52) U.S. Cl. ..... 70/423; 70/428; 70/455

(58) Field of Classification Search ..... 70/54–56, 70/423, 424, 427, 428, 454, 455
See application file for complete search history.

(56) References Cited

U.S. PATENT DOCUMENTS

| | | | | | |
|---|---|---|---|---|---|
| 1,439,038 | A * | 12/1922 | Teich | ..... | 70/455 |
| 1,517,924 | A * | 12/1924 | Teich | ..... | 70/455 |
| 1,619,972 | A * | 3/1927 | De Waters | ..... | 70/247 |
| 1,648,251 | A * | 11/1927 | Zygmunt | ..... | 70/455 |
| 1,843,586 | A * | 2/1932 | Werckmeister | ..... | 70/427 |
| 2,070,955 | A | 2/1937 | Parisoe | | |
| 2,132,287 | A * | 10/1938 | Curtis et al. | ..... | 70/455 |
| 2,140,239 | A * | 12/1938 | Lewis | ..... | 16/86 A |
| 2,217,730 | A | 10/1940 | Cooley | | |
| 2,247,592 | A * | 7/1941 | Swift | ..... | 70/455 |
| 2,564,012 | A * | 8/1951 | Jordan | ..... | 70/455 |
| 2,585,331 | A * | 2/1952 | King | ..... | 70/455 |
| 2,658,376 | A * | 11/1953 | Shank | ..... | 70/455 |
| 2,670,623 | A * | 3/1954 | Haltenberger | ..... | 70/455 |
| 2,930,219 | A * | 3/1960 | Fansmith | ..... | 70/428 |
| 4,286,445 | A * | 9/1981 | Sills | ..... | 70/55 |
| 4,798,069 | A * | 1/1989 | DeForrest, Sr. | ..... | 70/428 |
| 6,240,755 | B1 | 6/2001 | Da Silva | | |
| 6,272,890 | B1 * | 8/2001 | Huston | ..... | 70/423 |
| 6,459,373 | B1 | 10/2002 | Edwards | | |
| 6,933,831 | B2 | 8/2005 | Ieda et al. | | |
| 7,401,484 | B1 * | 7/2008 | Holmes et al. | ..... | 70/423 |
| 2008/0190157 | A1 * | 8/2008 | Mizuno | ..... | 70/455 |

* cited by examiner

*Primary Examiner*—Suzanne D Barrett
(74) *Attorney, Agent, or Firm*—Alex Porat; Magna Closures Inc.

(57) ABSTRACT

A handle assembly for a vehicle is provided that includes a handle body that is attached to the vehicle door. A key cylinder is mounted to the handle body and is operable to manually lock and unlock the vehicle door. A cover is provided that is movable between a covered position that hides the key cylinder from view and an open position that exposes the key cylinder. The cover can slide or pivot between the open and closed positions. The cover protects the key cylinder from the elements and improves the overall appearance of the vehicle door.

2 Claims, 1 Drawing Sheet

HIDDEN KEY CYLINDER

This application claims the benefits of U.S. Provisional Application No. 60/775,085 filed Feb. 21, 2006.

FIELD OF THE INVENTION

The present invention relates to door locks for motor vehicles. More specifically, the present invention relates to key cylinders that engage and disengage the door locks.

BACKGROUND OF THE INVENTION

Most automobiles today are equipped with a keyless entry system that enables the operator to press a button on his or her remote key fob to unlock the vehicle doors. This feature is so popular with consumers as to virtually eliminate the use of the key cylinders on the side of the door, trunk or hatch. However, for safety reasons, key cylinders are retained for emergency situations such as the failure of the vehicle's electrical system or if the remote key fob's battery dies.

If the door lock key cylinder is not used for long periods of time, it can become seized due to rust and dirt that enters the key cylinder from exposure to the elements. Additionally, door lock key cylinders are not pleasant to look at and hinder the overall look of the car door. It is therefore desired to provide a way to protect and hide the door lock key cylinders while still providing the necessary safety advantages that the key cylinders provide.

SUMMARY OF THE INVENTION

According to a first aspect of the invention, there is provided a handle assembly for a vehicle door. The handle assembly includes a handle body that is attached to the vehicle door. A key cylinder is mounted to the handle body and is operable to manually lock and unlock the vehicle door. A cover is provided that is movable between a covered position that hides the key cylinder from view and an open position that exposes the key cylinder.

The present invention provides a door lock assembly for hiding or exposing from view a vehicle door lock key cylinder. This device allows the door lock key cylinder to remain hidden and protected when not in use and become exposed when manual actuation of the key cylinder is necessary.

DETAILED DESCRIPTION OF THE INVENTION

Figure 1A:
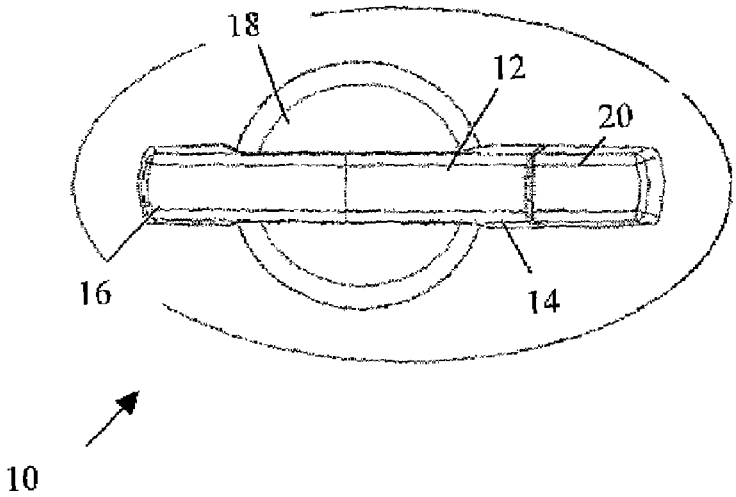
FIG. 1A shows an isolated view of a portion of a vehicle door featuring a handle assembly with a key cylinder cover in a closed position.

Referring now to FIG. 1A, a portion of a vehicle door 10 is shown. Door 10 is typically a front side door on the vehicle, although other doors such as rear doors, hatches or trunk lids could also be used. Door 10 includes a curved handle 12 that includes ends 14 and 16. Handle 12 operates in a conventional manner. Alternatively, an electronic sensor (not shown) can be integrated into handle 12. If the handle 12 is grabbed while door 10 is unlocked, an electric actuator (not shown) releases the door latch to open door 10. A concave recess 18 is provided in side door 10 between ends 14 and 16 to provide greater clearance for the user's hand.

Figure 1B:
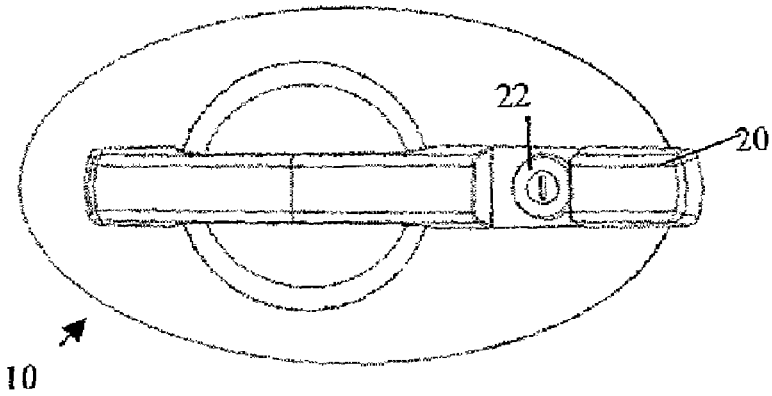
FIG. 1B shows an isolated view of a portion of the vehicle door shown in FIG. 1A, with the key cylinder cover in an opened position.

A movable cover 20 is provided near end 14 of handle 12 and is shaped as to maintain a continuous profile with the curve of handle 12. Cover 20 is manufactured from metal or plastic and is colored to match the color of handle 12. In the presently illustrated embodiment, cover 20 slides between a closed position adjacent end 14, shown in FIG. 1A, and an open position away from handle 12, shown in FIG. 1B, thereby revealing a key cylinder 22. A spring detent (not shown) retains cover 20 in the open position during use and keeps it normally closed. Key cylinder 22 is connected via rods or cables to the locking mechanism and is operable to engage or disengage the locks on side door 10 as part of a manual override. When key cylinder 22 is not in use, cover 20 is slid against end 14, thereby hiding key cylinder 22.

Figure 2:
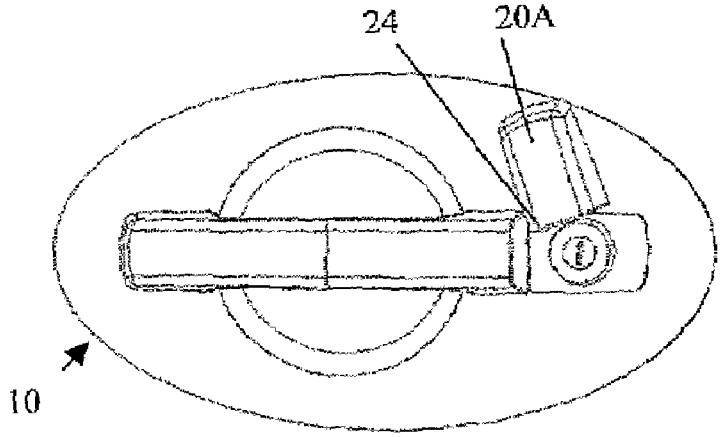
FIG. 2 shows an isolated view of a portion of a vehicle door featuring a second embodiment of the invention.

FIG. 2 shows a second embodiment of the invention. Instead of sliding between the closed and open positions, cover 20A pivots around an axis 24 that is perpendicular to handle 12 to reveal key cylinder 22. Other methods of moving cover 20 to reveal key cylinder 20, such as providing hinges at the end of cover 20 to pivot it away from side door 10 are also within the scope of the invention.

What is claimed is:

1. A handle assembly for a vehicle door, the handle assembly including:

a handle body extending between first and second ends, the handle body attachable to the vehicle door and defining a longitudinal axis;

a key cylinder mounted to the handle body adjacent the first end; and a cover slidably coupled to the first end of the handle body, wherein the cover moves in a direction away from the second end of the handle body to an open position that exposes the key cylinder and moves in a direction toward the second end to a closed position that hides the key cylinder from view, by sliding along a longitudinal axis common with the longitudinal axis of the handle body.

2. The handle assembly of claim 1, wherein the cover protects the key cylinder from environmental damage when in the closed position.

* * * * *